United States Patent [19]

Buss

[11] Patent Number: 4,793,586

[45] Date of Patent: Dec. 27, 1988

[54] QUOIN MOLDS

[76] Inventor: Cecil F. Buss, 30 Mine Rd., Quakertown, Pa. 18951

[21] Appl. No.: 90,447

[22] Filed: Aug. 28, 1987

[51] Int. Cl.[4] ..... E04F 21/04

[52] U.S. Cl. ..... 249/15; 249/16; 249/19; 249/48; 249/158; 249/171

[58] Field of Search ..... 249/15, 16, 19, 20, 249/21, 48, 119, 132, 155, 158, 170, 171, 185, 194, 83, 90

[56] References Cited

U.S. PATENT DOCUMENTS

| | | | |
|---|---|---|---|
| 1,500,121 | 7/1924 | Fontaine | 249/19 |
| 1,564,578 | 12/1925 | Kennedy | 264/33 |
| 2,286,531 | 6/1942 | Fralick | 264/33 |
| 2,893,098 | 7/1959 | Tilley | 249/115 |
| 3,426,490 | 2/1969 | Taylor | 249/15 |
| 3,702,180 | 11/1972 | Jones | 249/188 |
| 4,659,055 | 4/1987 | Hardt | 249/19 |

*Primary Examiner*—Jay H. Woo
*Assistant Examiner*—James C. Housel
*Attorney, Agent, or Firm*—Steele, Gould & Fried

[57] ABSTRACT

A reusable mold and method for applying stucco to intersecting planar surfaces to create a quoin is disclosed. The mold is a generally rectangular framework of non-adhering surfaces. Preferably, each mold has two longitudinal members and at least two non-continuous mated cross members which are hingedly joined so that the mold can bend at its transverse midpoint to rest flat against two adjacent planar surfaces. In use, a cement base coat is placed on the surfaces. The mold is tacked in place and the open areas of the mold are filled with cement to form quoins. After the quoins harden, the mold is removed and the entire surface, including molded quoin, is finished with stucco.

15 Claims, 2 Drawing Sheets

QUOIN MOLDS

BACKGROUND OF THE INVENTION

1. Field of the Invention

This invention relates to building forms and, in particular, to a reusable form and method for applying a cementitious substance to planar surfaces.

2. Description of the Prior Art

There are many forms for shaping the materials of construction used in building trades. Among these are forms common for making concrete blocks of many shapes. Poured concrete structures are also shaped by the use of molds. In many cases, molds built of wood are fabricated on the location to frame buildings to particular specifications.

Many houses and buildings today are being constructed with stucco exterior wall coverings. Stucco is both decorative and durable, but requires application by skilled workers to achieve a satisfactory appearance. To this end, many molds have been developed to aid in the application of decorative layers of cementitious products to buildings. Examples of molds for cementitious products are U.S. Pat. Nos., 3,702,180 to Jones; 2,893,098 to Tilly; 2,286,531 to Fralich; and 1,564,578 to Kennedy.

Jones discloses a mold for casting a thin concrete panel with one flat face and one face in relief. The molds are made on the ground and placed on a building after formation.

Tilly discloses a disposable, pan-shaped, bendable mold. He nails wire mesh to a building and applies a layer of cementitious material on the mesh. The pan shaped mold is then filled and lifted onto the building. The wire mesh stays in place, even after the molds are removed from the dried wall.

Fralich discloses a mold for casting stone shapes in which two pans are hinged together to form each mold. The molds are filled on the ground, lifted to the wall, held to the wall, vibrated, and then removed, the stone shapes remaining on the wall.

Kennedy discloses a pattern for marking walls in which patterned lath is put on the walls and covered with cementitious material. At corners, he either abuts the next pattern against the first pattern, or he provides hinges which extend outward from the pattern. If two patterns are butted against each other, problems in aligning them and holding them in the proper position arise. If a hinge is used, it allows the form to be used in only one direction and also inhibits the smooth application of material over the pattern.

In many buildings, decorative applications of stucco are often added to the corners, both inner and outer, in shapes known as quoins. In order to produce quoins of uniform shape and proper vertical alignment along the building, masons commonly build wooden forms at each job location. They then wrap wooden blocks with cement and apply them to the walls. When the cement is dry, stucco is applied over it. When the forms are removed, they usually can not be reused for another job. This process of building new forms for each job is time consuming and adds expense to the job as well as delaying the application of the final coat of stucco.

There is, therefore, a need for a reusable and reversible mold for building quoins which is adjustable for both inner and outer corners, does not require the use of wrapped wooden blocks, and is made of a material which is non-adhering to cementitious substances.

There is also a need for a single quoin mold which forms one quoin and for a multiple quoin mold which forms several quoins in vertical alignment.

SUMMARY OF THE INVENTION

The aforementioned prior art problems are obviated by this invention's quoin mold and method of applying stucco to a building to create a quoin. The mold is intended to be used, preferably, at the intersection of two planar surfaces, such as inner or outer corners of buildings, to produce a quoin. Throughout, the word "quoin" is used to mean generally a portion of a building which is a solid exterior angle and which is distinguished from adjacent surfaces by projecting outward from these surfaces. Also, quoin mold is mean to describe both a single quoin mold which forms one quoin, or a multiple quoin mold which forms a series of quoins in vertical alignment.

The mold of this invention is a framework, preferably made from or coated by polyethylene or polyurethane and, is therefore, non-adhering to stucco and cement products. The mold includes two longitudinal members and at least two non-continuous mated cross members, each cross member having two mated sections, each section hinged to its mate so that the mold bends at its transverse midpoint to rest flat against both planar surfaces. The mold may be fabricated to have one mold area and create one quoin, or it may have longer longitudinal members and a plurality of cross members to form multiple quoins. The longitudinal end pieces are continuous, no matter how many sets of cross members are provided. In the preferred embodiment, the molds will be supplied with one, two, three, four, or five sets of mated cross members to make molds of increasing length. Thus in use, molds of differing lengths may be used together to create a row of vertical quoins on a building corner.

Each mold is also provided with a plurality of removable upright members sized to span the distance between two sets of cross members. By moving these uprights into desired positions, quoins are created with identical heights but differing lengths.

The longitudinal members are, preferably, predrilled with nail holes to provide for easy and removable tacking of the mold to the planar surface. Also the longitudinal members may be hinged to the cross members, or they may be permanently secured to the cross member in a non-moving arrangement. If the longitudinal members are hinged, they provide an easily accessible tacking surface in tight corners where they may be bent around the next adjacent corner.

All hinges are preferably flush to the surface of either side of the mold, providing for reversible use of the mold.

In use, a base coat, preferably gray cement, is applied to adjacent walls. At either an inner or outer corner, the mold is placed flat against the first surface and bent at its hinges to also rest flat against the second surface. The mold is then tacked to the surface through, preferably, predrilled nail holes in the mold. The open areas of the mold are filled, preferably with grey cement, to form quoins and a trowel is drawn between the mold and the quoin to provide a smooth finish. After the cement hardens, the mold is removed from the surfaces and a finish coat of stucco is applied to all surfaces, including quoins.

It is, therefore, an object of this invention to provide a method of applying stucco to walls by utilizing a reusable mold to create quoins which is, therefore, both easier and faster than the conventional method.

It is another object of this invention to provide a mold for building quoins which is portable and reusable.

It is yet another object of this invention to provide a mold for building quoins which uses a framework with removable uprights to provide decorative effects.

It is still another object of this invention to provide a mold for building quoins which provides for formation of a repeat pattern of quoins in a vertical row.

It is another object of this invention to provide a framework which bends at its transverse midpoint.

It is a further object of this invention to provide a mold for producing quoins which includes hinges along the vertical members to allow the mold to bend for use in narrow areas.

It is yet a further object of this invention to provide a mold which utilizes flush hinges to provide for reversibility of the mold.

It is still a further object of this invention to provide a mold for producing quoins which is made of a non-adhering substance so that it is easily removed from the surface.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
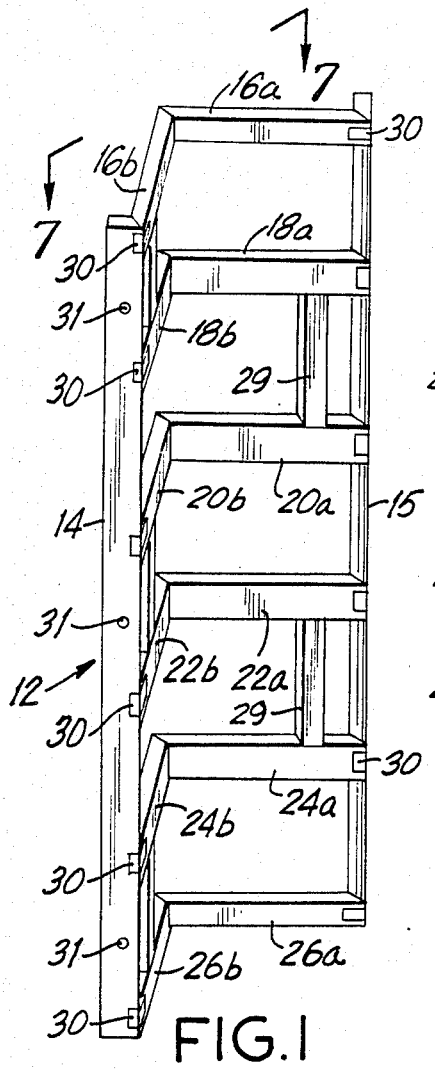
FIG. 1 is an isometric view of the preferred embodiment of the multiple quoin mold of this invention with a plurality of cross members and uprights.
Figure 2:
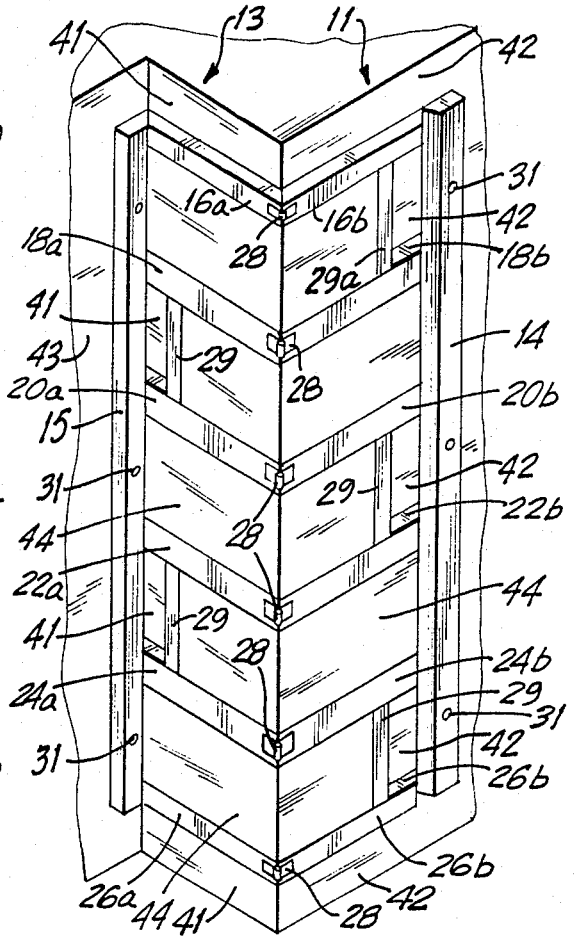
FIG. 2 is an isometric view of the multiple quoin mold of FIG. 1 in position on adjacent intersecting planar surfaces, predetermined mold areas filled with cementitious substance.

Referring now to the drawings, and more particularly to FIGS. 1 and 2, the preferred embodiment of this invention is illustrated as multiple quoin mold 12. Although only rectangular corner quoins are illustrated, quoin is used to describe a portion of a building which is a solid exterior angle and is distinguished from adjacent surfaces by projecting outward from these surfaces. It should be understood that although multiple quoin mold 12 has five sections to produce five quoins, and single quoin mold 10 in FIG. 3 makes one quoin, this invention is not limited to molds for one and five quoins only. The mold of this invention may be made in single, double, triple, quadruple, quintuple, etc. embodiments to provide for any desired number of quoins in a verticle row. Also although the quoin produced by the illustrated mold is generally rectangular with a length approximately double its width, other dimensions and shapes are possible and within the scope of this invention.

Referring to FIGS. 1 and 2, mold 12 is seen to be a framework with longitudinal members 14 and 15 and cross member pairs 16*a* and 16*b*, 18*a* and 18*b*, 20*a* and 20*b* 22*a* and 22*b*, 24*a* and 24*b*, and 26*a* and 26*b*. Each cross member pair comprises two cross members of equal length, hingedly joined endwise to one another. Each identically sized cross member section is joined to a longitudinal member by a hinge 30 to the other cross member of its pair, sometimes referred to herein as its mate, by a hinge 28. All hinges 28 and 30 provide for both reversibility and flexibility in the use of the mold of this invention. It is well known that all buildings are not perfectly square and that different buildings have corners which measure different degrees. The mold of this invention, because it can bend around corners and lay flat against adjacent walls, as illustrated in FIG. 2, eliminates the need for individually built forms each time a quoin is to be made. It may be turned upside down and used in the reverse pattern. The mold of this invention may even be used opened up to 180° and laid open against a wall for other decorative purposes, but its primary use is for building quoins on the corners of buildings. Hinges 28 provide flexibility for "bending around" outside corners. Hinges 30 provide flexibility for corners where the mold might be placed around one corner but extend into another.

Also seen in FIGS. 1 and 2 are nail holes 31 which are placed along the length of longitudinal members 14 and 15. In use, the molds are tacked to a wall through nail holes 31. Hinges 30 allow longitudinal members 14 and 15 to rest flat against the wall on which the quoin is made (as on wall 42) or to rest flat against the next adjoining wall (as on wall 43). Thus the nailing surface is always flat and accessible to the mason. Although nail holes 31 are preferred, they are not necessary, but aid in positioning the mold. They are especially desirable if the mold is made of plastic.

Also seen in FIGS. 1 and 2 are uprights 29. Uprights 29 are removable and are placed anywhere along the length of a cross member to provide the end frame for producing a quoin of any length. Although it is traditional to make quoins in the staggered pattern provided by the arrangement of uprights 29 in FIGS. 1 and 2 (and as shown completed in FIG. 8), it is always possible to create quoins of different lengths by moving uprights 29 to other positions. It is also possible to use mold 12 without any uprights 29 and produce a full quoin in the total space created by cross members and longitudinal members.

Figure 3:
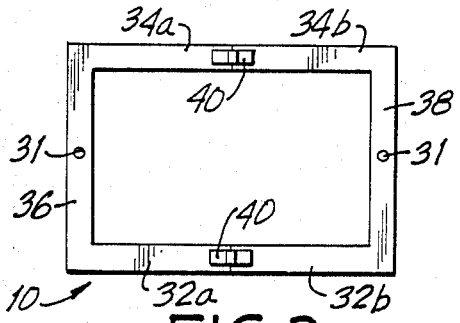
FIG. 3 is a top plan view of the outside of the single quoin mold of this invention.

Now referring to FIG. 3, a single quoin mold 10 is illustrated. Mold 10 has longitudinal members 36 and 38 and cross member pairs 32*a* and 32*b* and 34*a* and 34*b*. Hinges 40 join cross members 32*a* to 32*b* and 34*a* to 34*b*. It should be noted that mold 10 does not have end hinges. Although end hinges are preferred, they are not required since the essential hinging provision is needed at the mold's transverse midpoint for "wrapping around" corners. Single mold 10 may be used alone or in combination with other single or multiple molds, depending on user needs and preference.

Now referring to FIGS. 4, 5, 6 and 7, inside, outside and end views of the multiple quoin mold illustrated in FIGS. 1 and 2 are shown. Mold 12 is seen with longitudinal members 14 and 15 and uprights 29. Each cross member, 16*a* and 16*b*, 18*a* and 18*b*, 20*a* and 20*b*, 22*a* and 22*b*, 24*a* and 24*b*, and 26*a* and 26*b*, is hinged to its mate with hinge 28. Each section is also hinged to longitudinal members 14 and 15 by hinge 30. When opened flat, as here illustrated, it can be seen that the ends of each mated pair fit flush to each other and to longitudinal members 14 and 15. This is due to the mitered ends. As an example, cross member 16*a* is shown with mitered ends 49 and 48, and cross member 16*b* with mitered ends 50 and 46. Longitudinal member 15 has mitered end 52 and longitudinal member 14 has mitered end 51. Thus, cross members 16*a* and 16*b* and longitudinal members 14 and 15 may all be flat against a surface at the same time. Conversely, because of their mitered ends and hinges 28 and 30, cross members 16*a* and 16*b* and longitudinal members 14 and 15 may be angled toward or away from each other at varying angles to provide for a flat fit of mold 12 on both of two intersecting planar surfaces, regardless of the angle of intersection.

Now referring to FIGS. 2 and 8, the method of applying stucco to intersecting planar surfaces will be described. Once a building is constructed and exterior walls are in place, a base coat of gray cement is applied to predetermined exterior wall surfaces, as is well known in the art. Mold 12 is placed against an outside corner so that the framework around the areas to be filled is flat against both of two adjacent walls, 41 and 42. In FIG. 2, section 13, which includes longitudinal member 15, is flat against wall 41 and section 11, which includes longitudinal member 14, is flat against wall 42. Longitudinal member 14 is flat against wall 42, but longitudinal member 15 is bent to lay flat against adjacent wall 43. By bending member 15 against adjacent wall 43, the mason is able to nail it to a flat surface of wall 43. Mold 12 is then tacked into place against walls 41, 42 and 43 by lightly and removably nailing it through nail holes 31.

Next, as seen in FIG. 2, predetermined open areas are filled, preferably with gray cement to form quoins 44. For example, it can be seen that the area bordered by longitudinal member 15, cross members 16*a* and 16*b* and 18*a* and 18*b*, and upright 29*a* have been filled. The area bordered by upright 29*a*, longitudinal member 14 and cross members 16*b* and 18*b* is left unfilled so that the quoin created is not a full quoin, but a partial quoin as pictured in FIG. 8.

A trowel is drawn in the conventional manner between the mold and all edges of the formed quoins to smooth the edges which will later be exposed. Using the example above, the trowel smooths the quoin along upright 29*a*, cross members 16*a* and 16*b* and 18*a* and 18*b* and longitudinal member 15. The filled in mold areas are then allowed to harden, preferably for 12 to 24 hours. Filling of the mold and smoothing of the edges is simplified because all the hinges are flush and the tools can be run smoothly along all surfaces without catching in the hardware.

Mold 12 is then removed. Removal of mold 12 is readily and easily accomplished because mold 12 is, preferably, made of a material, such as polyurethane or polyethylene, which is non-adhering to cementitious products. An advantage of the mold of this inventon is that, once removed, mold 12 may be immediately used again.

Figure 8:
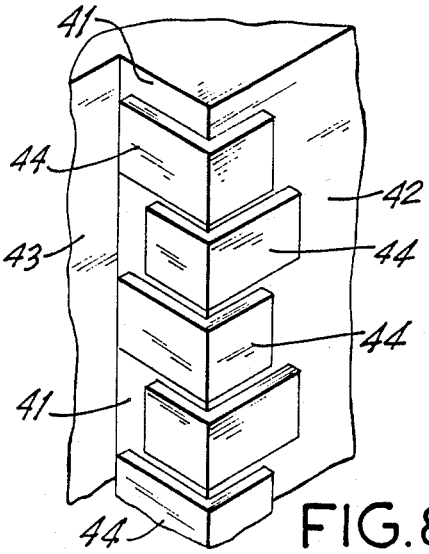
FIG. 8 is a partial isometric view of the finished quoins made with the multiple quoin mold as illustrated in FIG. 2.
Figure 4:
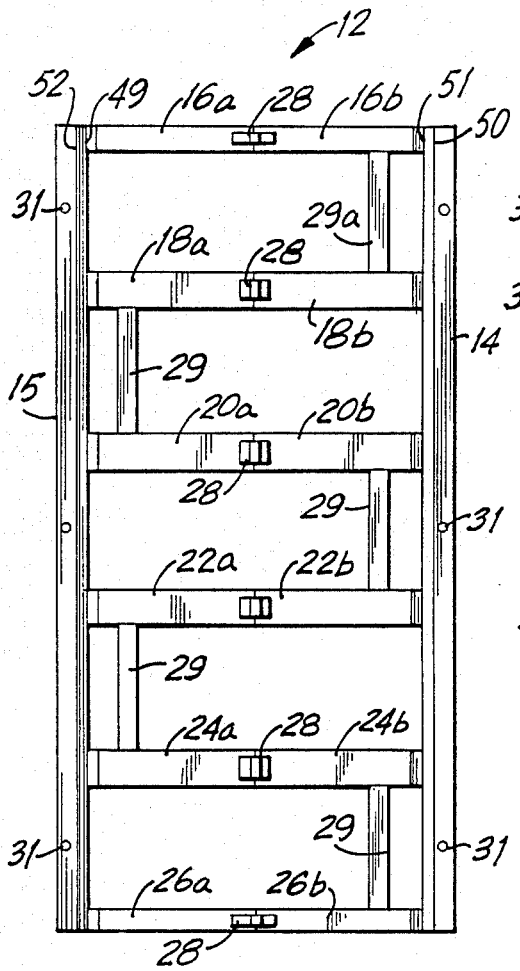
FIG. 4 is a top plan view of the outside of the multiple quoin mold of FIG. 1.
Figure 5:
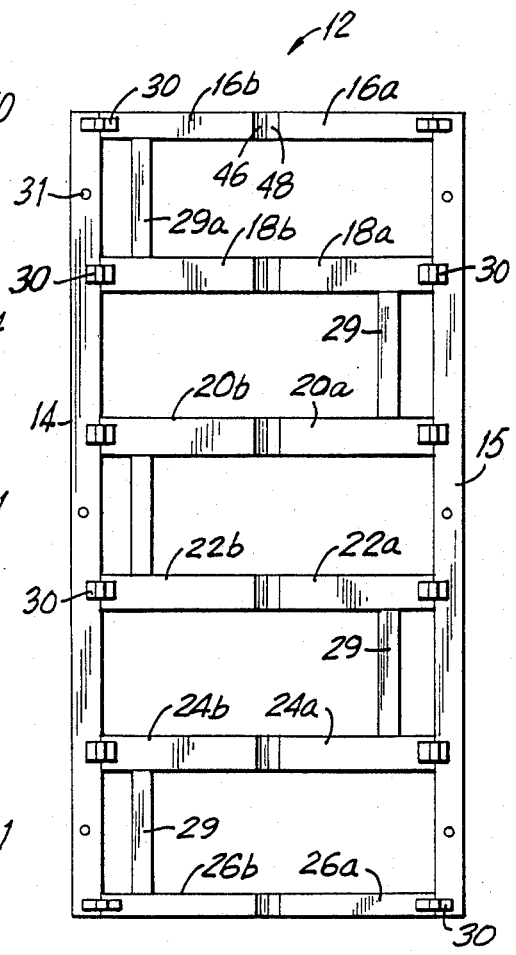
FIG. 5 is a top plan view of the inside of the multiple quoin mold of FIG. 1.
Figure 6:
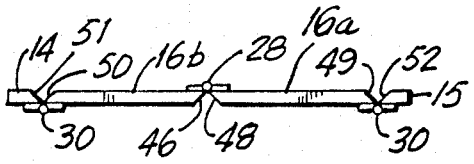
FIG. 6 is an end view of the multiple quoin mold showing both center and end hinges.
Figure 7:
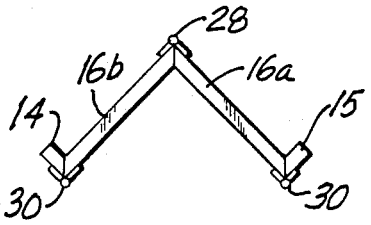
FIG. 7 is an end view of the multiple quoin mold taken on lines 7—7 of FIG. 1.

Lastly, a finish coat, preferably stucco, is then applied to all planar surfaces and to the quoins themselves, producing the walls 41, 42 and 43 and quoins 44 as illustrated in FIG. 8.

There are several variations which can be practiced in the scope of this invention. First, the mold may be for single or multiple quoins.

Second, the mold may be shaped in any number of shapes although rectangular is preferred.

Third, although polyethylene and polyurethane are preferred as materials of mold construction because they do not adhere to cement products and stucco, other materials of construction may be used, the molds may be laminated with non-adhering substances, or a conventional mold release spray may be used on the mold.

Also, the plastic flush and countersunk hinges illustrated herein are preferred because they do not interfere with the application of the stucco. Other hinges, such as metal, are possible and within the scope of this invention.

There are many advantages to the method and the mold of this invention. First, use of the mold provides a method which saves time because the masons do not have to build new quoin molds at each installation.

Second, because the molds are fabricated of a material to which cement and stucco do not adhere, they are immediately reusable.

Third, the mold of this invention can be made in any size and can include cross members to create any number and size of quoins.

Also, the mold of this invention utilizes plastic flush hinges which do not interfere with the application of stucco.

Having now illustrated and described my invention, it is not intended that such description limit this invention, but rather that this invention be limited only by reasonable interpretation of the appended Claims.

What is claimed is:

1. A reusable mold for use in applying a cementitious material to corners of intersecting planar surfaces, said mold comprising:

a generally rectangular framework with non-adhering surfaces, said framework including two opposed longitudinal members and at least two sets of cross member pairs joined to the longitudinal members, the cross members of each pair being of equal length and hingedly joined endwise to one another; and, each pair of cross members being further hingedly joined to each of the longitudinal members, whereby said mold may be folded over said corner and positioned with one cross member of each said pair flush on one of said intersecting surfaces and said longitudinal members may be selectively positioned flush on said surfaces and folded to accomodate other intersecting surfaces.

2. The reusable mold according to claim 1, wherein said framework includes a plurality of said cross member pairs in parallel, equally spaced alignment.

3. The reusable mold according to claim 1, further comprising at least one removable member mounted perpendicularly between adjacent cross members and flush therewith to define a rectangular quoin within the framework.

4. The reusable mold according to claim 2, further comprising a plurality of removable members, each mounted perpendicularly between selected adjacent cross members and flush therewith to define a plurality of rectangular quoins within the framework.

5. The reusable mold according to claim 1, wherein each cross member and each longitudinal member has a mitered edge at each hinged joint, the respective mitered edges of each joint flatly engaging one another when the respective hingedly connected members are substantially perpendicular to one another.

6. A reusable mold for use in applying a cementitious material to corners of intersecting planar surfaces, said mold comprising:

a generally rectangular framework with non-adhering surfaces, said framework including two opposed longitudinal members and at least two sets of cross member pairs joined to the longitudinal members, the cross members of each pair being of equal length and hingedly joined endwise to one another; and, each pair of cross members being further hingedly joined to the same one of the longitudinal members, whereby said mold may be folded over said corner and positioned with one cross member of each said pair flush on one of said intersecting surfaces and said same one of said longitudinal members may be selectively positioned flush on said surfaces and folded to accomodate other intersecting surfaces.

7. The reusable mold according to claim 6, wherein said framework includes a plurality of said cross member pairs in parallel, equally spaced alignment.

8. The reusable mold according to claim 6, further comprising at least one removable member mounted perpendicularly between adjacent cross members and flush therewith to define a rectangular quoin within the framework.

9. The reusable mold according to claim 7, further comprising a plurality of removable members, each mounted perpendicularly between selected adjacent cross members and flush therewith to define a plurality of rectangular quoins within the framework.

10. The reusable mold according to claim 6, wherein each cross member and each longitudinal member has a mitered edge at each hinged joint, the respective mitered edges of each joint flatly engaging one another when the respective hingedly connected members are substantially perpendicular to one another.

11. A reusable mold for use in applying a cementitious material to corners of intersecting planar surfaces, said mold comprising:

a generally rectangular framework with non-adhering surfaces, said framework including two opposed longitudinal members and at least two sets of cross member pairs joined to the longitudinal members, the cross members of each pair being of equal length; and, a hinge joining the cross members of each pair endwise to one another, each of the hinges being substantially flush mounted, whereby said mold may be folded over said corner and positioned with one cross member of each said pair and one of said longitudinal members flush on each of said intersecting surfaces, and a trowel and like tools may be moved smoothly over and immediately adjacent to the framework over the entire extent of the mold without obstruction.

12. The reusable mold according to claim 11, wherein said framework includes a plurality of said cross member pairs in parallel, equally spaced alignment.

13. The reusable mold according to claim 11, further comprising at least one removable member mounted perpendicularly between adjacent cross members and flush therewith to define a rectangular quoin within the framework.

14. The reusable mold according to claim 12, further comprising a plurality of removable members, each mounted perpendicularly between selected adjacent cross members and flush therewith to define a plurality of rectangular quoins within the framework.

15. The reusable mold according to claim 11, wherein each cross member has a mitered edge at each of the hinged joints, the respective mitered edges of each joint flatly engaging one another when the respective hingedly connected members are substantially perpendicular to one another.

* * * * *